US006719809B2

(12) United States Patent
Payet

(10) Patent No.: US 6,719,809 B2
(45) Date of Patent: Apr. 13, 2004

(54) TEXTILE FINISHING PROCESS

(75) Inventor: George L. Payet, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/071,464

(22) Filed: Feb. 7, 2002

(65) Prior Publication Data

US 2002/0138916 A1 Oct. 3, 2002

Related U.S. Application Data

(60) Division of application No. 09/267,654, filed on Mar. 15, 1999, which is a continuation-in-part of application No. 09/075,334, filed on May 11, 1998, now Pat. No. 5,885,303, and a continuation-in-part of application No. 09/163,319, filed on Sep. 30, 1998.

(60) Provisional application No. 60/046,298, filed on May 13, 1997.

(51) Int. Cl.[7] ..... D06M 13/127

(52) U.S. Cl. ..... 8/115.6; 8/493; 8/581; 8/183; 8/184; 8/185; 8/186; 427/393.2; 427/387; 510/287

(58) Field of Search ..... 8/493, 581, 115.6, 8/183, 184, 185, 186; 427/393.2, 387; 510/287

(56) References Cited

U.S. PATENT DOCUMENTS

| | | | | |
|---|---|---|---|---|
| 2,243,765 | A | | 5/1941 | Morton |
| 3,420,696 | A | | 1/1969 | Cotton et al. |
| 3,646,015 | A | | 2/1972 | Hamilton |
| 3,663,974 | A | * | 5/1972 | Watanabe et al. ..... 8/116.4 |
| 3,731,411 | A | | 5/1973 | Barber et al. |
| 3,807,952 | A | * | 4/1974 | Lauchenauer ..... 8/186 |
| 3,811,834 | A | | 5/1974 | Schwemmer et al. |
| 3,837,799 | A | | 9/1974 | Wilson et al. |
| 3,841,832 | A | | 10/1974 | Swidler et al. |
| 3,865,545 | A | | 2/1975 | Forg et al. |
| 3,960,482 | A | * | 6/1976 | Payet ..... 8/116.4 |
| 3,960,483 | A | | 6/1976 | Payet |
| 3,980,429 | A | | 9/1976 | Lawrence et al. |
| 4,067,688 | A | | 1/1978 | Payet |
| 4,072,466 | A | | 2/1978 | Hermann |
| 4,104,022 | A | | 8/1978 | Payet |
| 4,108,598 | A | | 8/1978 | Payet |
| 4,184,004 | A | | 1/1980 | Pines et al. |
| 4,312,993 | A | | 1/1982 | Martin |
| 4,331,797 | A | | 5/1982 | Martin |
| 4,396,390 | A | * | 8/1983 | Hendrix et al. ..... 8/116.4 |
| 4,464,506 | A | * | 8/1984 | Alberts et al. ..... 524/588 |
| 4,475,917 | A | | 10/1984 | Ohshima et al. |
| 4,520,176 | A | * | 5/1985 | Martin et al. ..... 524/598 |
| 4,530,874 | A | * | 7/1985 | Hendrix et al. |
| 4,619,864 | A | | 10/1986 | Hendrix et al. |
| 4,790,856 | A | | 12/1988 | Wixon |
| 5,021,264 | A | | 6/1991 | Kästele et al. |
| 5,458,544 | A | | 10/1995 | Fujiwara et al. |
| 5,480,485 | A | | 1/1996 | McClain et al. |
| 5,879,410 | A | | 3/1999 | Yanai et al. |
| 5,885,303 | A | * | 3/1999 | Payet |
| 6,375,685 | B2 | * | 4/2002 | Payet ..... 8/116.4 |

FOREIGN PATENT DOCUMENTS

| | | |
|---|---|---|
| CH | 557447 | 7/1974 |
| WO | WO9500697 | 1/1995 |
| WO | WO9910589 | 3/1999 |
| WO | WO9958758 | 11/1999 |

OTHER PUBLICATIONS

Isharani, *Book of Papers*, "Ultratex–New Breed of Textile Finish." 144–153 (1982).

Carr, Editor, *Chemistry of the Textiles Industry*, 271–272 (1995).

* cited by examiner

*Primary Examiner*—Charles Boyer

(74) *Attorney, Agent, or Firm*—Brahm J. Corstanje; Kim William Zerby; Steven W. Miller

(57) ABSTRACT

A process for treating a textile fabric to impart or enhance at least one property of the fabric comprising:

introducing the fabric into an aqueous formaldehyde containing solution to provide a wet pickup of an effective amount of the solution by the fabric, applying to the fabric an effective amount of a catalyst for catalyzing a reaction between formaldehyde and the fabric;

thereafter exposing the wet fabric to a temperature of at least about 300° F. to react the formaldehyde with the fabric to impart or enhance the property of the fabric before there is a substantial loss of formaldehyde from the exposed fabric.

12 Claims, No Drawings

TEXTILE FINISHING PROCESS

CROSS REFERENCES TO RELATED APPLICATIONS

The present application is a divisional application of U.S. application Ser. No. 09/267,654 filed Mar. 15, 1999, which was (a) a continuation-in-part of U.S. application Ser. No. 09/075,334, now U.S. Pat. No. 5,885,303, which claims benefit under 35 U.S.C. §119(e) of prior application No. 60/046,298 filed May 13, 1997 now abandoned; and (b) a continuation-in-part of copending application Ser. No. 09/163,319, filed Sep. 30, 1998.

BACKGROUND OF THE INVENTION

1. Field of Invention

This invention relates to a textile finishing process using aqueous formaldehyde for treating various fabrics including fabrics containing cellulose fibers and fabrics containing protein fibers. The process is also applicable to fabrics containing combinations of these and different fibers, such as synthetic fibers, e.g. polyesters. Textile finishing processes using formaldehyde as a reactive component are well known but suffer from many disadvantages. This invention relates to new textile finishing processes using aqueous formaldehyde, compositions and treated fabrics.

2. Description of Related Art

There are a number of known processes for treating textile fabrics with formaldehyde. The textile fabrics to be treated include those containing protein fibers such as wool and silk. The cellulosic fibers include cotton and rayon. These treatment processes include resin or polymer treatment of the fabric, but these are costly and unsatisfactory. Another process for treating fabrics and particularly cellulosic fiber-containing fabrics is a durable press process which relies on formaldehyde to provide durable cross linking of the cellulose molecules and to thereby impart durable crease resistant and smooth drying characteristics to these fabrics and products containing them. The textile fabrics to be treated are usually cotton/blend fabrics. Other synthetic fibers such as polyesters and the like are often included in these fabrics to provide additional properties. For example, polyester fibers are added to cotton fibers to form cotton/polyester blends. The polyester fibers are added to compensate for the loss in strength of the cotton fibers due to the formaldehyde treatment. Problems have been encountered with the known processes. A simple, reproducible, completely satisfactory low-cost formaldehyde treatment process, particularly, a durable press process has not yet been achieved.

It has long been known to treat cellulosic materials with formaldehyde, as is evidenced by U.S. Pat. No. 2,243,765. This patent describes a process for treating cellulose with an aqueous solution of formaldehyde containing a small proportion of an acid catalyst under such conditions of time and temperature that the reaction is allowed to approach its equilibrium. In carrying out this process, the proportion of the solution of formaldehyde to the cellulose must be at least such that the cellulose is always in a fully swollen state. The time and temperature of the treatment with the solution of formaldehyde and acid catalyst will vary with one another, the time required increasing rapidly as the temperature diminishes. When it is desired, the product may be isolated by washing and drying; preferably at a temperature of about 212° F. The products obtained according to this process are said to show no increase in wet strength and possess a high water of imbibition, an increased resistance to creasing and a slight increase in affinity to some direct dyes.

In recent years additional methods have been devised for treating cellulosic fiber-containing products in order to impart durable crease retention, wrinkle resistance and smooth drying characteristics to these products. As discussed, formaldehyde has been cross linked with cellulose materials to produce these products. It is also known to treat cellulose materials with resins or precondensates of the urea-formaldehyde or substituted urea-formaldehyde type to produce a resin treated durable press product. As noted in U.S. Pat. No. 3,841,832, while formaldehyde has made a significant contribution to the cotton finishing art, the result has been far from perfect. For instance, in some cases the formaldehyde cross linking treatment has tended to lack reproducibility, since control of the formaldehyde cross-linking reaction has been difficult. As noted in U.S. Pat. No. 4,396,390, lack of reproducibility is especially true on a commercial scale.

Moreover, unacceptable loss of fabric strength has also been observed in many of the proposed aqueous formaldehyde treatment processes. When high curing temperatures were used with an acid or potential acid catalyst, excess reaction and degradation of the cotton often happened which considerably impaired its strength. On the other hand, when attempts were made to achieve reproducibility at temperatures of 106° F. or less, much longer reaction or finishing times were usually required, rendering the process relatively unattractive economically. A solution to this is set forth in U.S. Pat. No. 4,108,598, the entire disclosure of which is herein incorporated by reference. Rayons, e.g. regenerated cellulose (both viscose and cuprammonium) are described in this patent as cellulosic containing fibers as is known to the prior art.

SUMMARY OF THE INVENTION

This invention relates to a textile finishing process for treating a textile fabric to impart or enhance at least one property of the fabric. Such properties include durable press characteristics of the fabric and preferably durable press properties are imparted to the fabric while reducing loss of the fabric's strength during the finishing process. Further properties include a reduction in fabric shrinkage and/or an improvement in the ability for aqueous laundering of the treated fabric. The invention also includes compositions or composites used in the process and the fabrics treated by the processes.

The invention includes a process for treating a textile fabric to impart or enhance at least one property of the fabric comprising introducing the fabric into an aqueous formaldehyde containing solution to provide a wet pickup of an effective amount of the solution by the fabric, applying to the fabric an effective amount of a catalyst for catalyzing a reaction between formaldehyde and the fabric; and exposing the wet fabric to a temperature of at least about 300° F. to react the formaldehyde with the fabric to impart or enhance the property of the fabric before there is a substantial loss of formaldehyde from the exposed fabric.

The aqueous solution may be applied to the fabric, preferably, by introducing the fabric into an aqueous solution to provide a wet pickup of an effective amount of the solution by the fabric. In one aspect, the treating solution comprises an effective amount of formaldehyde or formaldehyde generating material and a catalyst for catalyzing a reaction between formaldehyde and the fabric. After this initial application of the aqueous solution, which may be at ambient temperature, the fabric is thereafter exposed to a temperature of about 300° F. to react the aqueous formaldehyde with the fabric to impart or enhance at least one property of the fabric before there is a substantial loss of formaldehyde from the exposed fabric. This may be done by introducing the fabric into a heating zone having a temperature of at least about 300° F.

The fabric containing cellulosic fibers or protein fibers are reacted with aqueous formaldehyde when an elastomer is present. It is possible to obtain good durable press properties in a cellulosic fiber-containing fabric with good strength retention and consistent results by a durable press/wrinkle-free process for cellulosic fiber-containing fabrics. This process utilizes formaldehyde and catalysts with an elastomer to impart wrinkle resistance to the cellulosic fiber-containing fabrics while reducing loss in both tensile and tear strength. Silicone elastomers are preferred for use in the process. The process is particularly effective on 100% cotton fabrics.

Also included is a process for treating a textile fabric to enhance at least one property of the fabric comprising treating the fabric at ambient temperature with an aqueous formaldehyde solution and catalyst for catalyzing the reaction between formaldehyde and the fabric; and introducing the wet fabric into a heating zone having an elevated temperature of at least about 300° F. to subject the ambient temperature-treated fabric directly to the elevated temperature for reaction of the formaldehyde with the fabric to enhance the property of the fabric.

In another aspect of the invention, the process for treating a textile fabric with formaldehyde to enhance at least one property of the fabric comprises treating a fabric containing fibers selected from the group consisting of cellulosic fibers and protein fibers with formaldehyde to react with said cellulosic or protein fibers, and grafting an elastomer onto said cellulosic or protein fibers.

A further aspect of the invention includes a post treatment process to remove excess formaldehyde from the fabric by washing the treated fabric with an aqueous solution of a formaldehyde removing agent which may be an organic acid. Since the concentrations of treating chemicals, including formaldehyde will vary with the fabric being treated, the concentration of the formaldehyde removing agent can be determined by routine experimentation.

The process also includes the use of urea or a derivative thereof to increase the strength of the fabric. The treated fabrics also form part of the invention.

In yet a further aspect of the invention, stable chemical compositions or composites may be used to prepare the aqueous treating solutions for use in the processes of the invention.

The chemical compositions, including water and optional ingredients, which are applied to the fabric in the process may be applied to the fabric together from an aqueous system or sequentially anytime during the process so long as the sequence of addition of the various compositions to the fabric does not prevent the desired level of treatment in the fabric.

DESCRIPTION OF PREFERRED EMBODIMENTS

Cellulosic fiber-containing fabrics which may be treated by the process of the present invention include cloth made of cotton or cotton blends. There is a constant consumer demand for better treatment, that is, a more wrinkle-free product and for higher amounts of cotton in the blended fabric, or preferably, a 100% cotton fabric. There is a great demand for a wrinkle-free fabric made entirely of cotton and having good tensile and tear strength. 100% cotton fabrics are available, but only in heavier weight pants or bottom weight fabrics. Unfortunately, the more wrinkle-free the cellulosic containing fabric is made by treatment in a formaldehyde system, the greater the loss in tear and tensile strength and the treated fabric becomes weaker. It may become so weak as not to be a commercially viable product.

That is, as the amount of chemicals used in the treating process is increased to obtain an acceptable wrinkle resistance in the treated fabric, the loss in tear and tensile strength may fall to unacceptable levels. Polyester fibers are most often blended with cotton fibers to compensate for the loss in strength of the treated cotton to form the well known cotton/polyester blend fabrics. Polyester in amounts of up to 65% are commonly used. Because of the presence of polyester fibers or other synthetic fibers in the blend, these blended fabrics are sufficiently strong but do not have the comfort or feel of fabrics containing a higher amount of cotton, or most desirably, 100% cotton. The process of the present invention overcomes the disadvantages of the prior art processes and permits the presence of higher percentages of cotton in the blend and even the treatment of lighter weight or shirting weight 100% cotton fabrics to a commercially acceptable wrinkle free standard while retaining adequate strength in the fabric to also make it commercially acceptable. Commercial acceptability of the treated fabric is the ultimate goal of the process.

A preferred aspect of the invention comprises a durable press process for treating cotton containing fabrics, including 100% cotton fabric, by treating a cellulosic fiber-containing fabric with aqueous formaldehyde and a catalyst capable of catalyzing the cross linking reaction between formaldehyde and cellulose in the presence of an elastomer, preferably a silicone elastomer, heat curing the treated cellulosic fiber-containing fabric, preferably having a moisture content of more than 20% by weight, under conditions at which formaldehyde reacts with the cellulose in the presence of a catalyst and without the substantial loss of formaldehyde before the reaction of formaldehyde with cellulose to improve the wrinkle resistance of the fabric while reducing the loss in both tensile and tear strength. It is preferable that the cellulose containing fabric is in the fully swollen state.

The elastomer may be applied to the fabric with the aqueous formaldehyde and catalyst solution. This allows the simultaneous application of all of the treating chemicals to the fabric in one treating solution. However, the necessary chemicals, including water and optional ingredients, may be applied to the fabric sequentially anytime during the process so long as the sequence does not prevent the desired level of treatment in the fabric. The elastomer is usually obtained as a commercially available emulsion. Specific elastomeric containing compositions which may be used in the process of the invention include those which dry to a film having elastomeric properties when a small amount of the elastomer containing composition is poured onto an open surface and allowed to dry. This is a simple test to determine elastomers which are useful in the process. It is also advantageous if the elastomer selected results in a treated fabric which is hydrophilic. Fabrics which are hydrophilic, that is, do not repel water are generally more comfortable to the wearer. A hydrophilic (wetable with water) durable press fiber containing fabric in accordance with this invention has formaldehyde crosslinks and elastomer grafts. The fabric preferably has silicone elastomer grafts and the fabric is preferably cellulosic containing which includes rayon.

While any elastomer may be used, silicone elastomers are particularly preferred. Any silicone elastomer may be used in the present invention. Silicone elastomers are known materials. Silicone elastomers have a backbone made of silicon and oxygen with organic substituents attached to silicon atoms comprising n repeating units of the general formula:

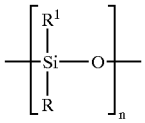

The groups R and $R^1$ may be the same or different and includes for example, lower alkyl, such as methyl, ethyl, propyl, phenyl or any of these groups substituted by hydroxy groups, fluoride atoms or amino groups; in other words, reactive groups to cellulose, e.g. cotton and rayon.

The silicones used to make the silicone elastomers used in the present invention are made by conventional processes which may include the condensation of hydroxy organosilicon compounds formed by hydrolysis of organosilicon halides. The required halide can be prepared by a direct reaction between a silicon halide and a Grignard reagent. Alternate methods may be based on the reaction of a silane with unsaturated compounds such as ethylene or acetylene. After separation of the reaction products by distillation, organosilicon halides may be polymerized by carefully controlled hydrolysis to provide the silicone polymers useful in the present invention.

For example, elastomers may be made by polymerization of the purified tertramer using alkaline catalysts at 212–302° F., the molecular weight being controlled by using a monofunctional silane. Curing characteristics and properties may be varied over a wide range by replacing some methyl groups by —H, —OH, fluoroalkly, alkoxy or vinyl groups and by compounding with fillers as would be appreciated by the skilled artisan.

Silicone elastomers used in the present invention are high molecular weight materials, generally composed of dimethyl silicone units (monomers) linked together in a linear chain. These materials usually contain a peroxide type catalyst which causes a linking between adjacent methyl groups in the form of methylene bridges. The presence of cross linking greatly improves the durability of the silicone elastomer on the treated fiber by producing larger molecules.

Another group of reactive silicone polymers are the hydrophilic organosilicone terpolymers which are elastomers and which contain a plurality of reactive epoxy groups and a plurality of polyoxyalkylene groups as described in U.S. Pat. No. 4,184,004, the entire disclosure of which is herein incorporated by reference. Other silicone elastomers which may be used in the process of the present invention include the ester containing silylated polyethers described in U.S. Pat. No. 4,331,797, the entire disclosure of which is herein incorporated by reference. Also incorporated by reference is the disclosure of U.S. Pat. No. 4,312,993 which describes silylated polyethers which may be used in the process of the present invention.

It is also possible to produce a reactive silicone elastomer, which is one where reactive groups capable of reacting with the substrate have been added to the linear dimethyl silicone polymer. These silicones are capable of reacting both with cellulose substrates as well as with most protein fibers, and are characterized by much greater durability of the silicone polymer on the substrate, even approaching the life of the substrate.

Therefore silicone elastomers which give off reaction products indicating chemical reaction with the substrate are much preferred over non-reactive silicone elastomer, but this is not to say that nonreactive silicone elastomers cannot be used in the process. Different elastomers, from different manufacturers have all shown increases in tensile as well as tear strength as shown in Tables I and II included herein. Elastomeric silicone polymers have been found to increase strength whereas simple emulsified silicone oils (or lubricants) do not give increases in tensile strength.

The aqueous system containing formaldehyde, an acid catalyst, elastomer and a wetting agent, may be padded on the fabric to be treated preferably, from the same bath, to insure a moisture content of more than 20% by weight on the fabric. However, the various treatment chemicals may be added sequentially at various treating stations during the process. These may be arranged so that the process is a continuous process. The fabric is then cured by exposing it to a high temperature. The padding technique is conventional to the art and generally comprises running the fabric through the aqueous solution which is then passed through squeezing rollers to provide a wet pickup of from about 50 to 100% or more, generally, about 66%. The concentration of the reactants in the aqueous solution(s) and the dwell time of the fabric in the treating solution may be adjusted to provide the desired amount of reactants on the weight of the fabric (OWF).

In a preferred aspect of the invention, the fabric is pre-moistened before it is run through the chemical treatment bath containing the formaldehyde and catalyst(s). Premoistening may be with water alone or an aqueous solution containing a wetting agent. Conventional wetting agents well known to one of ordinary skill in the art of durable press treating cotton containing fabrics with formaldehyde may be employed in the solution, generally in amounts of 0.1% (0.1% solids OWF) based on the weight of the solution. This results in an insignificant amount of wetting agent applied to the fabric, based on the weight of the fabric. This wetting agent insures that the treating solution will find its way into the fibers so that the entire fiber is treated with the treatment solution, and not just the outside of the fiber. (This would lead to a very poor treatment). Any wetting agent can be used which does not adversely effect the process. Non-ionic wetting agents are preferred since ionic agents can cause break down of the treating solution, especially the elastomer emulsion, hence, the wetting agent should be carefully chosen, and tested in the laboratory as would be appreciated by one of ordinary skill in the art. This is a routine procedure.

The pretreatment with the aqueous solution may be obtained by running the fabric through an aqueous bath and then through rollers to remove excess moisture or by the use of conventional low wet pick-up equipment, i.e., vacuum equipment etc., and to control the amount of moisture in the fabric prior to the application of the treatment chemicals in a separate bath. It is essential to know the moisture content of the fabric reaching the treatment bath so that the concentrations of the chemicals applied in the treatment bath can be determined and adjusted to insure that the correct amounts of reactants are on the fabric prior to exposure to the high curing temperature to obtain the desired levels of treatment. The amount of moisture on the fabric prior to the application of the treatment chemicals will dilute the amount of chemicals which the fabric "sees" after the pre-moistened fabric is run through the treatment bath.

The above procedure, which is known as a wet on wet application of the aqueous chemicals, produced 13% higher strength than when the chemicals were applied to dry fabric. Shrinkage was considerably better when dealing with wet rather than dry fabric.

Regardless of the reaction mechanism, one thing is known for sure, complete wetting and saturation is obtained when the fabric has been pre-wet, whereas on dry fabric, there is no guarantee that the fabric and all fibers are thoroughly saturated and swollen to the same degree. It has been found that the dry fabric is difficult to wet out evenly as it was padded with aqueous chemical treatment solutions. In the wet on wet application, water and wetting agent were applied first, giving time for complete saturation before the aqueous chemicals were applied. This is an example of a two step sequential process for application of water and the chemicals.

While not wishing to be bound by any theory, if one were to visualize a fabric where there are spots of heavily wetted areas, next to areas that are not wet out, the heavily wet out areas contain more chemical than they should, as the application should have spread to the area where there is nothing, or less solution. Treatment where the chemical concentration is higher will be more severe than in an adjacent area where less chemicals are found. It is the poor wet out, or poor uniformity that leads to weak, or over treated micro areas as well as strong untreated areas in the fabric. The strength of the fabric is only as good as the weakest spot.

Now visualize a fabric that has been wet out to 50% with water before chemicals are applied and which is then suddenly dipped in a treating solution having twice the concentration of chemicals, (two times stronger to account for the water already in the fabric). Now, as the chemical solution is diluted two to one with the water in the fabric, not only is a normal concentration achieved, but the chemicals can move everywhere in and on the fibers. This insures more uniform application of the treating chemicals in the fabric. There are no concentrated areas, everything is equally treated, hence the chemical reaction will give a fabric without micro-weak spots.

It is noted that when treating dry fabric, that is fabric with an ambient amount of moisture, half the amount of formaldehyde was used, for reasons outlined above. (The pre-wet out fabric already contains water.) What is not clear is that in applying the aqueous mixture to dry fabric, one half of the catalyst concentration was not used. The reason for this is not so obvious. Catalyst concentration runs it's own curve and does not necessarily follow the formaldehyde curve precisely. It levels off sooner, hence if one half of the catalyst concentration used in wet on wet treatments had been used in the wet on dry treatments, there would not have been enough catalyst present to give a good reaction or good treatment. The concentration used is based on all the previous work done on application of aqueous mixtures to a dry fabric. By consulting previous data, the appropriate catalyst concentration was chosen, and as the data shows, strengths, though a bit less than wet on wet treatments, are quite close. What is surprising is that shrinkage control in the dry fabric treatments is not as good. If the catalyst concentration had been cut in half, shrinkage would have been even worse.

The addition of urea to the fabric results in a significant increase in strength retention in the fabric. Urea may be applied in the treating solution simultaneously with the other chemicals or sequentially alone or in combination with an optional ingredient. In some samples where urea was added, there was a 30% increase in strength compared to the samples which were treated without urea in a treating bath. Urea may be added to the aqueous treating composition to provide from 0.5 to 3% of urea on the weight of the fabric, preferably from 1–2% OWF, or may be applied sequentially to arrive at the same amounts on the fabric.

The mechanism of this strength increase is not known as yet, but it is totally reproducible on woven fabrics, and knits. The urea is preferably first dissolved in water before adding to the treatment bath, and is added just before any wetting agent is added to the treatment bath. As noted above, a wetting agent may also be added in the premoistening step. Surprisingly, the use of urea left the fabric treated stronger by at least 30% in both tensile as well as tear strength. This effect of urea appears to be peculiar to the aqueous system of the present invention, as it does not give the increase in strength with other formaldehyde cross linking processes. However, there is a very slight lessening of the durable press, that is, DP value. It is a simple matter to increase the treatment to account for the half point drop in DP and still realize the 30% strength increase.

While it is preferred to use urea, urea derivatives which are compatible with the aqueous system may also be used in comparable amounts which may be readily determine by one skill in the art based on the amount of urea added to the system. These derivatives include substituted ureas where one or more organic groups are substituted for one or more of the urea hydrogen atoms. Such organic groups include lower alkyl, i.e., methyl, ethyl, propyl, provided that the urea derivatives' water solubility in the aqueous system is not adversely effected. Similarly, thiourea and its water soluble derivatives may also be used.

It has been further found that a stable composition is obtained when the urea is added to the aqueous emulsion of the silicone elastomer in a concentrate to form a composite which can be stored for long periods of time and then diluted at the time of use. This avoids the separate addition of urea at the time of addition of formaldehyde to form the treating bath for application to the fabric to be treated. For example, the formaldehyde, the composite and water could be added to the pad bath in the proper ratio for treating the fabric. This approach lends itself to pumping from a storage drum, with a good pumping system to maintain the proper ration, and thus eliminate the requirement for making up a tank of the treating solution. However, formaldehyde or catalyst should not be added to the composite as the combination of elastomer, urea and formaldehyde or catalysts are not sufficiently stable for prolong storage.

The treatment level is largely dictated by the amount of formaldehyde used in the treating solution, but also by the amount of catalyst employed. Catalyst should be used in a ratio with the formaldehyde, e.g., more formaldehyde, more catalyst, etc. Urea may affect the level of treatment but the other components, such as the wetting agent and other conventional optional ingredients have no affect on the level of treatment.

The level of treatment selected is dictated by the fabric, some fabrics can withstand high level of treatment, others cannot. The following are rules of thumb, but experimental trials should show what treatments can be used.

It is possible to use unexpected high temperatures which allow the cross linking reaction to take place before the loss of formaldehyde is great enough to affect the process and provide inadequate treatment. In accordance with this aspect of the invention, the padded fabric may be immediately plunged into a heating chamber at from about 300 to about 325° F. This is an important commercial aspect of the invention as it enables continuous processing on a commercial scale at speeds of 15–200 yards per minute depending upon type of fabric and fibers. It must be appreciated, that this process is designed for commercial applications which are demanding in that the process must be commercially viable.

This may also be accomplished by curing at a low temperature with an active catalyst and/or the presence of the elastomer. It is also possible to use any combination of techniques which prevent the substantial loss of formaldehyde during the curing. For example, a low temperature may be used in combination with an aqueous formaldehyde solution. It would also be possible to use a pressurized system wherein the pressure is greater than atmospheric, thereby preventing the substantial loss of formaldehyde before the formaldehyde crosslinks with the cellulosic fiber-containing fabric being treated.

In addition, when the process of the present invention is applied to cotton containing fabrics, including 100% cotton fabrics, it uses less formaldehyde than other known processes. Shirting fabrics treated in accordance with the process of the present invention contain approximately 6000 ppm after treatment before steaming on a shirting fabric as compared to 7000 ppm+ by another cross linking process on a similar shirting fabric. Tests have shown that continuously running steaming chambers to which the treated fabric is exposed should effectively remove residual formaldehyde to concentrations as low as 200 ppm. This is also an important aspect of the present invention in view of consumers concern about the presence of formaldehyde in their purchased garments. It is also possible to wash fabrics either continuously or in batch washers. Both approaches remove essentially all of the formaldehyde.

It is known to add to the fabric a polymeric resinous additive that is capable of forming soft film. For example, such additives may be a latex or fine aqueous dispersion of polyethylene, various alkyl acrylate polymers, acrylonitrile-butadiene copolymers, deacetylated ethylene-vinyl acetate copolymers, polyurethanes and the like. Such additives are well known to the art and are generally commercially available in concentrated aqueous latex form. Such a latex is diluted to provide about 1 to 3% polymer solids in the aqueous catalyst-containing padding bath before the fabric is treated therewith. One known softener which was virtually the softener of choice in the durable press process using resin treatment or formaldehyde cross linking was high density polyethylene, Mykon HD. It has been unexpectedly discovered that the substitution of a silicone elastomer for high density polyethylene significantly reduces the loss in tear strength of the treated fabric after washing as well as providing better control of the process as may be seen from the examples. The importance of good control of the process is essential to a commercially viable process to provide a consistent product from run to run which is not adversely affected by variations in atmospheric pressure, humidity and the like.

As the cellulosic fiber-containing fabric which may be treated by the present process there can be employed various natural cellulosic fibers and mixtures thereof, such as cotton and jute, Other fibers which may be used in blends with one or more of the above-mentioned cellulosic fibers are, for example, polyamides (e.g., nylons), polyesters, acrylics (e.g., polyacrylonitrile), polyolefins, and any fiber stable at the reaction temperature. Such blends preferably include at least 35 to 40% by weight, and most preferably at least 50 to 60% by weight, of cotton or natural cellulose fibers. Rayon and rayon containing blends are also included. Rayon is a generic term for synthetic textile fibers whose chief ingredient is cellulose or one of its derivatives.

The fabric may be a resinated material but preferably it is unresinated; it may be knit, woven, non-woven, or otherwise constructed. After processing, the formed wrinkle resistant fabric will maintain the desired configuration substantially for the life of the fabric. In addition, the fabric will have an excellent wash appearance even after repeated washings.

This invention is not dependent upon the limited amounts of moisture to control the cross linking reaction since the cross linking reaction is most efficient in the most highly swollen state of the cellulose fiber. Lesser amounts of moisture may be used but are less preferred.

However, when employing the silicone elastomer in the process, the silicone elastomer must be present in a sufficient amount to reduce the loss of tensile and tear strength in the fabric normally associated with the treatment of the same fabric in a prior art treatment process which may include the use of softeners such as Mykon HD. The formulation and process of the present invention may be adjusted to meet specific commercial requirements for the treated fabric. For example, formaldehyde and the catalyst concentration may be increased to provide better treatment; then the concentration of the softener is also increased to combat the loss of tear strength caused by the increased amount of catalyst used in the process. This lends itself to computerized control of the systems for treating various fabrics and allows variation in the treatment of different fabrics, which is another advantage of the process of the present invention. While silicone oils are known as silicone softeners and have found some use in fabric treatment, they suffer serious disadvantages in having a strong tendency to produce non-removable spots. However, the particular silicone elastomer used in the process of the present invention completely overcomes these problems.

Blended fabrics to be treated in accordance with the present invention are immersed in a solution to provide a pick up or on the weight of fabric (OWF) of about 3% formaldehyde, 1% of catalyst, 1% of the silicone elastomer. This may be done sequentially or by one solution. This requires a pickup of about 66% by weight of the aqueous formulation to achieve the above stated percentage of reactants on the fabric when one simultaneously. However, when treating 100% cotton fabric chemical concentrations must be increased so that 5% formaldehyde OWF, about 2% catalyst and about 2% elastomer padded onto the fabric. This is contrary to the prior art attempts to treat 100% cotton where the concentration of reactants were decreased because of the loss of strength due to the treatment process. The curing temperature may be about 300° F. In fact, the padded fabric may be plunged into a oven or heating chamber at 300° F.

The formaldehyde concentration may be varied as would be appreciated by one of ordinary skill in the art depending on the fabric to be treated. The process includes the use of formaldehyde in the form of an aqueous solution having a concentration of 0.5% to 10%, by weight for cotton containing fabrics. The preferred formaldehyde concentration on the fabric is from 1.5% to 7% based on the weight of the cotton containing fabric.

Rayon fiber-containing fabrics may be treated with an aqueous mixture containing a high concentration of formaldehyde, and a catalyst capable of catalyzing the cross linking reaction between formaldehyde and the rayon, wherein the concentration of the formaldehyde is sufficient to produce a durable press fabric, and heat curing the treated fabric to produce a durable press rayon fabric which does not shrink substantially on aqueous washing. This process may also include an effective amount of an elastomer and particularly a silicone elastomer in the aqueous mixture and heat curing the treated rayon fiber-containing fabric under conditions at which formaldehyde reacts with the rayon in the presence of the catalyst and elastomer, without a substantial loss of formaldehyde before the reaction of the formaldehyde with the rayon, to improve the wrinkle resistance of the fabric while reducing loss in tear and tensile strength. The curing temperature may be about 350° F. In fact, the padded fabric may be plunged into a oven or heating chamber at 350° F.

The formaldehyde concentration may be varied as would be appreciated by one of ordinary skill in the art. The process includes the use of formaldehyde in the form of an aqueous solution having a concentration of about 14% to 20%, by weight for the treatment of rayon containing fabrics. The preferred formaldehyde concentration on the rayon fabric is from 15% to 18% based on the weight of the fabric (OWF).

The removal of formaldehyde from the treated fabric is a further aspect of this invention which comprises the use of a subsequent chemical treating or washing step. This is advantageous for commercial processing at the mill. It has been found that treating the finished fabric after curing with a solution of formaldehyde removing agent such as an organic acid, such as oxalic acid, formic acid or the like; will result in a fabric with acceptable formaldehyde levels. The concentration of the acid in the aqueous treating solution can be determined by routine experimentation and will obviously be dependent on the concentration of formaldehyde used in the process. Concentrations of the acid may vary from about 0.5 wt. % to about 3 wt. % in the treating solution.

Higher formaldehyde concentrations are also required for the treatment of protein fibers such as silk or wool. As previous noted, silicone elastomers react with protein fibers. For years, formaldehyde has been used on wool, but not for producing durable press properties. If the wool fiber is treated with 4.0% formaldehyde on the weight of the goods as recommended in the literature, the natural wool crosslinks are reinforced thus rendering the wool more resistant to alkali degradation. There is also an allegation that wool exhibits reduced shrinkage.

However, if wool is treated with extremely high concentration of formaldehyde in the process of the present invention, and with a catalyst, preferably, an active catalyst, a considerable amount of durable press (DP) is imparted to the woolen fabric treated by the process of the present invention. The mechanical shrinkage common to wool, where the opposing surface scales interlock, allowing the fiber to move only in one direction, hinders the durable press (DP) properties in wool. Formaldehyde cross linking of the wool fiber is not strong enough to overcome mechanical shrinkage, which is brought about by heat, water and detergent which open the scales. It has been have found that wool fabrics which have been shrink proofed (chlorination, treatment with potassium permanganate, or hydrogen peroxide) prior to treatment with formaldehyde exhibit remarkably good DP after water washing in a home washing machine at 140° F.

Formaldehyde concentrations, much higher than cited in the literature, are similar to those used in treating rayon, e.g. 16% formaldehyde on the weight of the fabric, and 4.5% Catalyst LF. The normal softeners are employed.

These treatments are effective on non shrink-proofed wool, but are not good for more than one or two washings, where felting shrinkage (mechanical) begins to occur. As the felting shrinkage increases, the DP is lost.

Silk, chemically similar to wool, but physically quite different also undergoes some stabilization, but in a very subtle way. Comparison to the untreated control show a smoother fresher appearance, and less fine wrinkling, the same concentrations as used on wool are recommended. There is a strong retention of the shine or glitter of the silk fibers, after washing, when silk was treated by the process of the invention.

The catalyst used in the process includes fluorosilicic acid for mild reactions and is applicable to blend fabrics. On heavyweight, all-cotton fabrics, or shirting fabrics, a catalyst such as magnesium chloride spiked with citric acid can be used, which is a commercially available catalyst Freecat No. 9, as is a similar catalyst which contains aluminum/magnesium chloride. A group of catalysts which may be used in the present invention include those described in U.S. Pat. No. 3,960,482, the entire disclosure of which is herein incorporated by reference. These catalysts include acid catalysts including acid salts such as ammonium, magnesium, zinc, aluminum and alkaline earth metal chlorides, nitrates, bromides, bifluorides, sulfates, phosphates, and fluorborates. Magnesium chloride, aluminum and zirconium chlorohydroxide and mixtures thereof may also be used.

Water soluble acids which function as catalysts in the present process include both inorganic and organic acids such as sulfamic acid, phosphoric acid, hydrochloric acid, sulfuric acid, adipic acid, fumaric acid, citric acid, tartaric acid and the like may also be used. The catalysts may be used alone or in combination as can be readily determine by one of ordinary skill in the art.

On heavyweight, all-rayon fabrics, or shirting fabrics, a catalyst such as magnesium chloride spiked with citric acid can be used, which is a commercially available catalyst, Freecat LF. Freecat No. 9, is another magnesium chloride catalyst which contains aluminum/magnesium chloride. These catalysts are available from Freedom Textile Chemicals.

Catalyst LF is a particularly active or "Hot" version of the magnesium chloride catalyst used in conventional formaldehyde treatment process of cotton and it contains magnesium chloride salt and an organic acid, such as citric acid to boost the acidity. Other acids may also be used. Catalyst LF was developed to cure the hard-to-react low formaldehyde resins. Oddly enough, one would expect that since it is more acid than Catalyst No. 9, (magnesium chloride only) that it would cause greater damage and more strength loss. This is not the case, this catalyst more often than not produces higher treatment and better strength.

During the cross linking reaction at the curing stage, moisture is given up from the fabric as the cross linking occurs, resulting in a decrease in the moisture content of the fabric. In fabrics having a moisture content of 20% or less, this tends to lower the effectiveness of the cross linking reaction requiring higher concentrations of formaldehyde. In a preferred aspect of the present invention, moisture is given up from a high level, that is, greater than 20%, preferably greater than 30%, e.g., from 60–100% or more, and the cross linking is optimized. Moisture, which is so difficult to control, is not a problem in the present invention. Of course, water is not allowed to be present in so much of an excess as to cause the catalyst to migrate on the fabric.

All results reported in the following examples were obtained by the following standard methods:

1. Appearance of Fabrics after Repeated Home Launderings: AATCC Test Method 124-1992
2. Tensile Strength: ASTM: Test Method D-1682-64 (Test 1C)
3. Tear Strength: ASTM: Test Method D-1424-83 Falling Pendulum Method
4. Shrinkage: AATCC Test Method 150-1995
5. Wrinkle Recovery of Fabrics: Recovery Angle Method: AATCC Test Method 66-1990 gives degrees rotation and AATCC Test Method 143-1992 provides the DP value.

In determining the DP value for the fabrics, a visual comparative test is performed under controlled lighting conditions in which the amount of wrinkles in the treated fabric is compared with the amount of wrinkles present on pre-wrinkled plastic replicas. The plastic replicas have various degrees of wrinkles and range from a value of 1 DP for a very wrinkled fabric to 5.0 DP for a flat wrinkle free fabric. The higher the DP value, the better. For a commercially acceptable wrinkle free fabric, a DP value of 3.5 is desired but rarely achieved. As would be appreciated by one of ordinary skill in the art, the difference between a DP of 3.50 and 3.25 is significant. At DP 3.50 all wrinkles are rounded and disappearing. At DP 3.25 all wrinkles are still visible and show sharp creases. The goal for commercial acceptance for a cotton fabric is a DP of 3.50 with a filling tensile strength 25 pounds and a filling tear strength of 24 ounces. (Prior to this invention there was no DP for rayon since it could not be treated by formaldehyde DP processes). Of equal or even greater importance to these properties is that the process must be consistently reproducible on an industrial scale.

Moreover, shrinkage control is very important property and DP values which would not be acceptable for treated cotton become acceptable for rayon provided that shrinkage is controlled. This shrinkage control is obtain on rayon fiber-containing fabrics by treating the rayon fiber-containing fabric with an aqueous mixture containing a high concentration of formaldehyde, and a catalyst capable of catalyzing the cross linking reaction between formaldehyde and the rayon, wherein the concentration of the formaldehyde is sufficient to produce shrinkage control of the fabric, and heat curing the treated fabric to produce a treated rayon fabric which does not shrink substantially on aqueous washing.

In all of the following examples a non-ionic wetting agent was used as is conventional to the art. The wetting agent was used in an amount of about 0.1% by weight. The wetting agents used in the cotton examples was an alkyl aryl polyether alcohol such as Triton X-100. The wetting agent used in the rayon examples was a trimethyl nonanolethoxylate such as Union Carbide Tergitol TMN6. The wetting agent is used to cause complete wetting by the aqueous treating solution of the fibers in the fabric. The wetting agent is used to cause complete wetting by the aqueous treating solution of the fibers in the fabric.

All-cotton fabrics are the most difficult to treat because of the severe loss in tensile and tear strength caused by the treatment process. This loss in tensile and tear strength causes the treated fabric to be commercially unacceptable. The normal industry standard for tear and tensile strength for an all cotton shirting fabric is characterized by having a filling tensile strength of 25 pounds and a filling tear strength of 24 ounces. The cotton fabric must meet and/or exceed this standard. The test conditions are set forth in the table.

In some of the tests on cotton containing fabrics, the silicone elastomer was the commercially available softener Sedgefield Elastomer Softener ELS, which is added as an opaque white liquid which contains from 24–26% silicone, has a pH of from 5.0–7.0 and is readily dilutable with water. When used in the present invention, this product produced DP values at catalyst concentrations of 0.8%, whereas with the Mykon HD, a catalyst concentration of 2.0% was required to give a DP value of 3.50 after 1 washing and 3.25 after 5 washings.

Another silicone elastomer which was used was the commercially available dimethyl silicone emulsion sold by General Electric with a product number SM2112. This material is added as an opaque white liquid which contains from 24–26% silicone elastomer, has a pH of from 5.0–8.0 and is readily dilutable with water.

The tensile strength with a catalyst concentration of 0.8% and tear strength are significantly and unexpectedly higher than the 2.0% catalyst required with Mykon HD to give equal DP results. Catalyst concentration of 1.0% ELS is recommended to ensure a margin of safety, such that any variation in treatment will be well within accepted specifications.

Formaldehyde was in the form of an aqueous solution which was prepared from commercially available Formalin which is a 37% aqueous formaldehyde solution.

As is conventional in the art, all percentages given in the examples and tables are based on the product or chemicals as receive from the manufacture. The percentage is weight percent and in most instances is based on the weight of fabric being treated, except for the wetting agent which is added as a weight percent of the bath from which it is applied. The following examples are being presented not as limitations but to illustrate and provide a better understanding of the invention.

The amount of pick up of the treating solution from the bath by the fabric was determined by running the fabric through a padding bath containing only water and then through the squeeze rollers. The weight of a specific amount of dry fabric is determined and compared to the same amount of fabric after going through the padding bath and squeeze rollers. This amount of pick-up is expressed as percentage pick-up. For example, 90% pick up means that the fabric picks up 90% of its original weight after moving through the padding bath and through the squeeze rollers. Obviously the amount of pick-up will depend on how fast the fabric moves through the bath and the nip pressure between the rollers and the propensity the fabric has for wetting. These parameters may be adjusted to control the amount of pick-up which in turn controls the concentration of chemicals in the padding bath to control the percentage of chemicals which are on the weight of the fabric. The techniques for making these adjustments are well known in the art and one of ordinary skill in the art would appreciate that it is necessary to know the amount of pick-up so that the amount of chemicals on the weight of the fabric (OWF) can be determined and thereby control the reaction on the fabric and obtain the desired results.

The following examples are being presented not as limitations but to illustrate and provide a better understanding of the invention. In order to confirm the fact that formaldehyde was being lost from the conventional processes, experiments were conducted in which the fabric was heated very quickly by very hot air as in the conventional processes as well as in accordance with the present invention.

EXAMPLE 1

As indicated, it is possible to cure with a high enough temperature that the cross linking reaction is achieved before sufficient formaldehyde is lost preventing good treatment. In this experiment, 100% cotton oxford shirting was padded with formaldehyde (37%) at a concentration of 5.0% OWF, 0.8% OWF of Freecat #9 Accelerator manufactured by Freedom Textile Chemicals Co. and 1.5% OWF of a silicone elastomeric softener, Sedgesoft ELS manufactured by Sedgefield Specialties, to a pickup of approximately 60–70%. The sample was then dried and cured while under tension in an air circulating oven set at 300° F. for 10 minutes.

EXAMPLE 2

Another sample of the same fabric as used in Example 1 was padded with a similar solution differing only in that the catalyst Accelerator #9 was 1.0% OWF. Otherwise the sample was treated precisely the same.

EXAMPLE 3

Another sample of the same fabric as used in Example 1 was padded with a similar solution differing only in that the catalyst Accelerator #9 was 2.0% OWF. Otherwise the sample was treated precisely the same.

EXAMPLE 4

Another sample of the same fabric as used in Example 1 was padded with a similar solution differing only in that the catalyst Accelerator #9 was 0.4% OWF, and Mykon HD was substituted for the Sedgesoft ELS elastomeric Softener. Otherwise the sample was treated precisely the same.

EXAMPLE 5

Another sample of the same fabric as used in Example 1 was padded with a similar solution differing only in that the catalyst Accelerator #9 was 0.8% OWF, and Mykon HD was substituted for the Sedgesoft ELS elastomeric Softener. Otherwise the sample was treated precisely the same.

EXAMPLE 6

Another sample of the same fabric as used in Example 1 was padded with a similar solution differing only in that the catalyst Accelerator #9 was 1.0% OWF, and Mykon HD was substituted for the Sedgesoft ELS elastomeric Softener. Otherwise the sample was treated precisely the same.

EXAMPLE 7

Another sample of the same fabric as used in Example 1 was padded with a similar solution differing only in that the catalyst Accelerator #9 was 1.5% OWF, and Mykon HD was substituted for the Sedgesoft ELS elastomeric Softener. Otherwise the sample was treated precisely the same.

EXAMPLE 8

Another sample of the same fabric as used in Example 1 was padded with a similar solution differing only in that the catalyst Accelerator #9 was 2.0% OWF, and Mykon HD was substituted for the Sedgesoft ELS elastomeric Softener. Otherwise the sample was treated precisely the same.

EXAMPLE 9

A sample of the same fabric was washed in a home washer and tumble tried, but not treated with any cross linking process.

EXAMPLE 10

Another sample of the same fabric served as an untreated, unwashed control.

It is clear in Table No. I that samples treated with the elastomeric softener produced higher degrees of durable press than any of the samples treated with Mykon HD. Tensile Strengths are similar as is shrinkage for each degree of treatment.

In another experiment, the results shown in Table No. II, samples of 100% cotton oxford shirting were padded with two concentrations of formaldehyde 3.0 and 5.0% OWF, each concentration also treated with three concentrations of Accelerator #9 Catalyst, 0.8, 1.0, and 2.0%. In one half of the samples, Sedgesoft ELS was applied and in the other half Mykon HD was used as the softener. Both softeners were applied at 1.5% OWF. Each of the samples were padded with the respective solutions shown in Table No. II, then cured at 300° F. for 10 minutes under tension. All samples were treated in precisely the same way, intervals were timed.

It is clearly seen in Table II (Example 11 to Example 22 and the control) that after 5 washes, the Sedgesoft ELS samples have almost twice

TABLE NO. I

Sedgefield Silicone Elastomeric Softener ELS vs. MykonHD, High Density Polyethylene
Fabric: New Cherokee 100% Cotton Oxford Shirting

| Example No. | Fabric Type | $CH_2O$ % OWF | Cat # 9 % OWF | Softener | Amount % OWF | Cure Temp. ° F. | Cure Time Min. | Tensile[1] W × F | Tear[1] W × F | Shrink 1 Wash W × F % | DP 1 Wash | Shrink 5 Washes W × F % | DP 5 Washes |
|---|---|---|---|---|---|---|---|---|---|---|---|---|---|
| 1 | Oxford | 5.0 | 0.8 | ELS | 1.5 | 300 | 10 | 45.3 × 46.0 | 59.4 × 45.2 | 1.08 × 0.58 | 3.50 | 1.50 × 0.83 | 3.50 |
| 2 | Oxford | 5.0 | 1.0 | ELS | 1.5 | 300 | 10 | 43.7 × 41.3 | 48.5 × 42.9 | 0.75 × 0.58 | 3.50 | 1.25 × 0.67 | 3.50 |
| 3 | Oxford | 5.0 | 2.0 | ELS | 1.5 | 300 | 10 | 30.0 × 29.0 | 28.9 × 25.5 | 0.75 × 0.67 | 3.50 | 0.92 × 0.75 | 3.50 |
| 4 | Oxford | 5.0 | 0.4 | Mykon HD | 1.5 | 300 | 10 | 61.8 × 69.8 | 103.8 × 79.5 | 2.00 × 1.42 | 2.0 | 2.50 × 1.08 | 2.00 |
| 5 | Oxford | 5.0 | 0.8 | Mykon HD | 1.5 | 300 | 10 | 53.0 × 56.2 | 72.9 × 53.4 | 1.67 × 1.08 | 2.75 | 1.83 × 0.92 | 2.50 |
| 6 | Oxford | 5.0 | 1.0 | Mykon HD | 1.5 | 300 | 10 | 47.2 × 47.2 | 60.3 × 42.4 | 1.17 × 0.83 | 3.25 | 1.17 × 0.67 | 2.50 |
| 7 | Oxford | 5.0 | 1.5 | Mykon HD | 1.5 | 300 | 10 | 39.3 × 37.5 | 36.6 × 26.6 | 0.83 × 0.67 | 3.25 | 0.75 × 0.33 | 3.00 |
| 8 | Oxford | 5.0 | 2.0 | Mykon HD | 1.5 | 300 | 10 | 34.7 × 35.0 | 27.8 × 25.5 | 0.75 × 0.67 | 3.50 | 0.75 × 0.42 | 3.25 |
| 9 | Control Unwashed | — | — | — | — | — | — | 74.3 × 99.0 | 120.1 × 133.2 | 2.00 × 1.58 | <1.0 | 4.42 × 1.83 | <1.0 |
| 10 | Control Washed | — | — | — | — | — | — | 71.7 × 100.8 | 35.7 × 63.9 | — | — | — | — |

[1]Evaluated after treatment but before washing

TABLE NO. II

Treatment: Comparison of Softeners, Sedgesoft ELS vs. Mykon HD
Sedgesoft ELS: Silicone Polymer Emulsion
Mykon HD: Polyethylene Emulsion
Specification Strength: Tensile, Filling: 25 lbs.; Tear, Filling: 24 oz.

| Example No. | Fabric New Cherokee Oxford Shirting | $CH_2O$ % OWF | Cat #9 % OWF | Softener Type | Softener Amt. % OWF | Cure/Time F./Min. | Tensile[1] Lbs. W × F | Tear[1] Oz. W × F | Shrink 1 Wash W × F % | DP 1 Wash | Shrink 5 Wash W × F % | DP 5 Washes | Tensile[2] 5 Washes W × F | Tear[2] 5 Washes W × F |
|---|---|---|---|---|---|---|---|---|---|---|---|---|---|---|
| 11 | 100% Cotton | 3.0 | 0.8 | ELS | 1.5 | 300/10 | 51.8 × 53.3 | 66.2 × 49.0 | 2.50 × 1.42 | 2.75 | 3.50 × 1.75 | 2.75 | 52.0 × 60.0 | 54.2 × 66.8 |
| 12 | 100% Cotton | 3.0 | 1.0 | ELS | 1.5 | 300/10 | 43.7 × 39.7 | 44.0 × 36.6 | 1.83 × 1.42 | 3.00 | 2.500 × 1.67 | 2.90 | 47.0 × 53.2 | 42.9 × 40.6 |
| 13 | 100% Cotton | 3.0 | 2.0 | ELS | 1.5 | 300/10 | 31.8 × 29.3 | 27.5 × 21.0 | 1.25 × 1.17 | 3.25 | 1.75 × 1.42 | 3.00 | 34.2 × 34.5 | 26.6 × 24.1 |
| 14 | 100% Cotton | 3.0 | 0.8 | HD | 1.5 | 300/10 | 54.8 × 55.7 | 75.2 × 50.8 | 2.00 × 1.58 | 2.75 | 2.92 × 2.00 | 2.00 | 56.8 × 65.8 | 29.4 × 32.3 |
| 15 | 100% Cotton | 3.0 | 1.0 | HD | 1.5 | 300/10 | 49.7 × 48.7 | 60.9 × 41.1 | 1.75 × 1.17 | 3.00 | 2.50 × 1.75 | 2.50 | 54.0 × 60.0 | 27.8 × 29.8 |
| 16 | 100% Cotton | 3.0 | 2.0 | HD | 1.5 | 300/10 | 38.2 × 34.2 | 29.4 × 23.3 | 1.17 × 1.255 | 3.25 | 1.67 × 1.33 | 3.00 | 35.5 × 39.8 | 19.6 × 19.9 |
| 17 | 100% Cotton | 5.0 | 0.8 | ELS | 1.5 | 300/10 | 46.7 × 44.0 | 56.4 × 35.4 | 1.92 × 1.25 | 2.75 | 2.42 × 1.33 | 2.90 | 47.0 × 59.5 | 50.3 × 65.5 |
| 18 | 100% Cotton | 5.0 | 1.0 | ELS | 1.5 | 300/10 | 43.2 × 38.2 | 40.6 × 30.5 | 1.58 × 1.08 | 3.00 | 1.91 × 1.00 | 3.00 | 38.0 × 51.8 | 43.3 × 58.0 |
| 19 | 100% Cotton | 5.0 | 2.0 | ELS | 1.5 | 300/10 | 30.8 × 27.3 | 26.6 × 27.5 | 1.08 × 0.92 | 3.25 | 0.75 × 0.75 | 3.25 | 30.0 × 37.3 | 28.7 × 33.2 |
| 20 | 100% Cotton | 5.0 | 0.8 | HD | 1.5 | 300/10 | 51.5 × 49.0 | 63.2 × 43.6 | 2.00 × 1.67 | 2.50 | 2.58 × 1.67 | 2.75 | 49.7 × 67.5 | 28.7 × 42.9 |
| 21 | 100% Cotton | 5.0 | 1.0 | HD | 1.5 | 300/10 | 44.0 × 46.0 | 40.0 × 31.8 | 1.67 × 1.58 | 2.50 | 2.00 × 1.33 | 3.00 | 49.3 × 52.0 | 29.8 × 37.7 |
| 22 | 100% Cotton | 5.0 | 2.0 | HD | 1.5 | 300/10 | 33.2 × 32.5 | 26.6 × 21.0 | 1.08 × 0.92 | 3.00 | 1.08 × 1.00 | 3.15 | 26.3 × 41.0 | 17.6 × 19.9 |
| Washed Control (5 Washes) | 100% Cotton | — | — | — | — | — | 74.1 × 106.7 | 77.4 × 103.8 | 2.92 × 1.67 | <1.0 | 3.30 × 1.00 | <1.0 | 70.1 × 109.7 | 37.7 × 59.4 |

[1]Evaluated after treatment but before washing.
[2]Evaluated after 5 washings.

the tear strength of the Mykon HD samples without exception. In addition, again seen, the DP values are higher indicating better smoothness.

EXAMPLE 23

Four samples of a rayon Challis fabric measuring 18×36 inches were padded with a treatment solution and run through squeeze rollers to provide the amount of treatment chemicals as indicated in the Table I. The treated fabric was applied to a pin frame and cured in an oven at the temperatures indicated. The pinned fabric was removed from the oven and then from the pin frame. The physical properties of the treated fabric were measured and recorded and are shown in TABLE III.

It is clear from Table III that increasing the amount of formaldehyde on the weight of the fabric (OWF) improves the DP value but reduces the strength of the fabric. This is also true with respect to the amount of shrinkage and the results show an entirely unexpected combination of DP and reduction in shrinkage.

EXAMPLE 24

Samples were prepared as in example 23 but from a rayon flax fabric with the necessary amounts of chemicals to provide the OWF values shown in Table IV. The curing temperature is 300 degrees and the dwell time was varied. The results are shown in TABLE IV.

EXAMPLE 25

Lenzing Lyocell rayon fabric was treated in accordance with the process of example 1 to provide the amounts of chemicals OWF as indicated in Table V. Table V shows the effectiveness of the process on Lyocell rayon.

TABLE III

| Sample No. | CH2O % OWF | Cat LF % OWF | SM2112 % OWF | Urea % 0WF | Cure/Time Deg F./Min | Tensile or Burst Strength | Tear or % Loss Burst Str. | Shrink 5Wash W × F | DP 5Wash |
|---|---|---|---|---|---|---|---|---|---|
| 778 | 10.0 | 3.4 | 1.5 | 2.0 | 300/10 | 81.5 × 75.3 | 108.4 × 107.2 | 2.83 × +0.2 | 3.25 |
| 779 | 15.0 | 4.3 | 1.5 | 2.0 | 300/10 | 74.3 × 69.2 | 84.0 × 87.4 | 1.25 × +0.67 | 3.50 |
| 780 | 20.0 | 5.1 | 1.5 | 2.0 | 300/10 | 67.8 × 50.5 | 72.7 × 59.1 | 0.50 × +0.16 | 4.00 |
| 777 | Control | — | — | — | — | 86.7 × 77.2 | 74.5 × 59.1 | 18.25 × 8.42 | 1.00 |

TABLE IV

| Sample No. | CH2O % OWF | Cat LF % OWF | SM2112 % OWF | Urea % 0WF | Cure 300 Deg F. Min | Tensile, Lb. W × F | Tear, Oz. W × F | Shrink 1-W W × F | DP 1-Wash |
|---|---|---|---|---|---|---|---|---|---|
| 959 | 15.0 | 4.3 | 1.5 | 1.0 | 10.0 | 107.0 × 71.0 | 128.2 × 95.5 | 0.17 × +0.91 | 3.50 |
| 960 | 15.0 | 4.3 | 1.5 | 1.0 | 7.5 | 111.7 × 70.0 | 119.9 × 100.9 | 0.42 × +0.75 | 3.50 |
| 961 | 15.0 | 4.3 | 1.5 | 1.0 | 5.0 | 117.5 × 77.2 | 138.4 × 119.0 | 0.83 × +0.5 | 3.25 |
| 962 | 15.0 | 4.3 | 1.5 | 1.0 | 2.5 | 124.5 × 83.8 | 183.5 × 146.1 | 2.00 × 0.33 | 3.00 |

TABLE V

| Sample No. | CH2O % OWF | Cat LF % OWF | SM2112 % OWF | Urea % 0WF | Cure/Time Deg F./Min | Tensile, Lb. W × F | Tear Oz. W × F | Shrink 1-Wash W × F | DP 1-Wash | Shrink 5-Wash W × F | DP 5-Wash |
|---|---|---|---|---|---|---|---|---|---|---|---|
| 945 | 15.0 | 4.3 | 1.5 | 1.0 | 280/10 | 87.0 × 49.7 | 105.0 × 67.1 | 0.42 × +0.17 | 4.0 | 0.17 × +0.65 | 3.50 |
| 946 | 15.0 | 4.3 | 1.5 | 1.0 | 300/10 | 76.8 × 34.7 | 68.2 × 51.5 | 0.00 × +0.17 | 4.0 | 0.25 × 0.50 | 3.50 |
| 947 | 15.0 | 4.3 | 1.5 | 1.0 | 300/10 | 74.6 × 42.0 | 86.22 × 54.9 | 0.17 × +0.17 | 4.0 | 0.17 × 0.50 | 4.00 |
| 948C | — | — | — | — | — | 120.8 × 80.8 | 60.5 × 37.7 | 2.92 × 2.00 | 1.0 | 4.00 × 1.25 | 1.00 |

TABLE VI

| Sample No. | Frabic and Color | CH2O % OWF | Cat LF % OWF | SM2112 % OWF | Urea % 0WF | Cure/Time Deg F./Min | Tensile, Lb. W × F |
|---|---|---|---|---|---|---|---|
| 728 | R&A Tan Union | 15.0 | 4.3 | 1.5 | 1.0 | 300/10 | 44.7 × 22.0 |
| 728C | Control | — | — | — | — | — | 74.0 × 49.0 |
| 729 | R&A Tan Plaid | 15.0 | 4.3 | 1.5 | 1.0 | 300/10 | 41.3 × 23.5 |
| 729C | Control | — | — | — | — | — | 82.3 × 50.8 |
| 730 | R&A Tan Check | 15.0 | 4.3 | 1.5 | 1.0 | 300/10 | 47.7 × 22.7 |
| 730C | Control | — | — | — | — | — | 76.3 × 44.5 |
| 731 | R&A Pink Plaid | 15.0 | 4.3 | 1.5 | 1.0 | 300/10 | 42.2 × 23.5 |
| 731C | Control | — | — | — | — | — | 66.0 × 42.7 |
| 732 | R&A Charcoal Union | 15.0 | 4.3 | 1.5 | 1.0 | 300/10 | 39.0 × 22.7 |
| 732C | Control | — | — | — | — | — | 72.8 × 45.3 |
| 733 | R&A Grey Houndstooth | 15.0 | 4.3 | 1.5 | 1.0 | 300/10 | 41.5 × 22.7 |
| 733C | Control | — | — | — | — | — | 73.2 × 43.3 |

TABLE VI-continued

| | | | | | | | |
|---|---|---|---|---|---|---|---|
| 734 | R&A Black/White Plaid | 15.0 | 4.3 | 1.5 | 1.0 | 300/10 | 40.0 × 27.8 |
| 734C | Control | — | — | — | — | — | 72.0 × 47.3 |

| Sample No. | Tear Oz. W × F | Shrinkage 1-Wash W × F | DP 1-Wash | Shrinkage 5-Wash W × F | DP 5-Wash |
|---|---|---|---|---|---|
| 728 | 64.3 × 44.7 | 1.92 × 0.17 | 4.00 | 2.83 × 0.42 | 3.50 |
| 728C | 77.2 × 108.4 | 19.91 × 13.2 | 1.00 | 19.6 × 29.0 | <1.00 |
| 729 | 76.8 × 41.8 | 1.25 × 0.58 | 3.75 | 1.92 × 1.25 | 3.50 |
| 729C | 95.5 × 110.2 | 20.1 × 7.93 | 1.50 | 20.0 × 14.2 | 1.00 |
| 730 | 72.2 × 59.1 | 1.00 × 2.00 | 3.50 | 1.25 × 2.42 | 3.25 |
| 730C | 83.5 × 94.8 | 14.0 × 8.83 | 1.00 | 19.2 × 13.1 | 1.00 |
| 731 | 85.8 × 58.2 | 1.58 × 2.75 | 3.25 | 3.00 × 3.58 | 3.00 |
| 731C | 90.8 × 51.2 | 9.25 × 17.2 | <1.00 | 13.3 × 28.1 | <1.00 |
| 732 | 72.2 × 46.3 | 1.75 × 0.50 | 5.00 | 2.42 × 0.33 | 5.00 |
| 732C | 93.2 × 104.4 | 14.42 × 19.7 | 1.00 | 19.8 × 26.5 | <1.00 |
| 733 | 68.4 × 22.7 | 0.67 × 3.83 | 3.25 | 1.25 × 5.00 | 3.40 |
| 733C | 106.6 × 87.4 | 6.33 × 6.58 | 1.50 | 10.8 × 11.7 | 1.00 |
| 734 | 67.1 × 58.7 | 1.50 × 3.00 | 5.00 | 1.92 × 4.17 | 5.00 |
| 734C | 74.0 × 66.2 | 12.75 × 12.25 | 1.00 | 18.5 × 18.5 | 1.50 |

EXAMPLE 26

A rayon and acetate fabric was treated in accordance with the process of example 23 to provide the amounts of chemicals OWF as indicated in Table VI. Table VI shows the effectiveness of the process on rayon acetate fabrics.

EXAMPLE 27

A 50/50 rayon/polyester fabric was treated in accordance with the process of example 23 to provide the amounts of chemicals OWF as indicated in Table VII. Table VII shows the effectiveness of the process on rayon/polyester fabrics.

This example shows the effect on a 50/50 polyester/rayon fabric which previously could not be sell as a washable fabric. These fabrics are not an intimate blend of rayon and polyester fibers, but woven such that some of the areas are 100% polyester and other are 100% rayon. The rayon shrinks on water washing, the polyester does not. The difference in this shrinkage of the two fibers causes severe puckering of the fabric, making it resemble a waffle. This fabric is normally sold as a "drycleanable" fabric but when treated in accordance with the present process results in a new product which will be washable.

EXAMPLE 28

A rayon and flax (85/15) fabric was treated in accordance with the process of example 23 to provide the amounts of chemicals OWF as indicated in Table VIII. Table VIII shows the effectiveness of different embodiments of the process on a rayon containing fabric.

The results in the table shows the effectiveness of the process using only formaldehyde and catalyst to achieve results which surpasses the

TABLE VII

| Sample No. | CH2O % OWF | Cat LF % OWF | SM2112 % OWF | Urea % 0WF | Cure/Time Deg F./Min | Tensile, Lb. W × F | Tear Oz. W × F | Shrink 1-Wash W × F | DP** 1-Wash | Shrink 5-Wash W × F | DP** 5-Wash |
|---|---|---|---|---|---|---|---|---|---|---|---|
| 714 | — | — | — | — | — | 73.5 × 54.0 | No Tear* | 3.33 × 5.67 | <1.00 | 3.33 × 7.25 | <1.00 |
| 715 | 8.0 | 2.8 | 1.5 | 1.0 | 300/10 | 55.0 × 36.5 | N.T. | 1.42 × 0.83 | 2.00 | 1.75 × 1.33 | 2.00 |
| 716 | 10.0 | 3.4 | 1.5 | 1.0 | 300/10 | 49.8 × 28.0 | N.T. | 1.25 × 0.92 | 2.00 | 1.33 × 0.92 | 2.00 |
| 717 | 12.0 | 3.8 | 1.5 | 1.0 | 300/10 | 42.0 × 38.0 | N.T. | 0.83 × 0.58 | 3.00 | 0.58 × 1.50 | 3.00 |
| 718 | 15.0 | 4.3 | 1.5 | 1.0 | 300/10 | 40.2 × 28.3 | N.T. | 0.83 × 0.92 | 5.00 | 1.08 × 1.33 | 5.00 |
| 719 | 20.0 | 5.1 | 1.5 | 1.0 | 300/10 | 36.0 × 27.0 | N.T. | 0.92 × 0.92 | 5.00 | 0.83 × 0.92 | 5.00 |

*Note: Tear value exceed the capacity of the Elmendorff Tester.
**Note: DP is based on reduction of the waffle effect, not on wrinkling as there is none.

TABLE VIII

| Sample No. | CH2O % OWF | Cat LF % OWF | SM2112 % OWF | Urea % 0WF | Tensile, Lb. W × F | Tear Oz. W × F | Shrink 1-Wash W × F | DP** 1-Wash |
|---|---|---|---|---|---|---|---|---|
| 969 | 18.0 | 5.4 | — | — | 69.5 × 50.5 | 53.1 × 41.8 | +0.33 × +1.08 | 3.50 |
| 970 | 18.0 | 5.4 | 1.5 | — | 76.2 × 49.8 | 87.4 × 74.5 | +0.58 × +1.00 | 4.00 |
| 971 | 18.0 | 5.4 | — | 1.0 | 77.5 × 59.3 | 61.0 × 55.8 | +0.50 × +1.33 | 3.50 |
| 972 | 18.0 | 5.4 | 1.5 | 1.0 | 85.0 × 59.8 | 97.8 × 76.1 | +0.41 × +1.17 | 4.00 |
| 973 control | — | — | — | — | 93.8 × 68.5 | 72.2 × 65.0 | 6.42 × 1.91 | 1.00 |

Note: Shrinkage with a "plus" sign indicates that the fabric extended, did not get smaller.

industry strength standards and produces a DP value of 3.5 which would be acceptable to the industry.

The results in the table show that on rayon containing fabrics, run with only formaldehyde and catalyst, achieve a fabric which surpasses the industry strength standards, and produces a DP value of 3.5. This fabric would be acceptable to the industry.

The table also shows that when silicone elastomer is added to the formaldehyde and catalyst, considerably higher strengths are realized and a DP of 4.00 is obtained.

Adding urea alone to the formaldehyde and catalyst results in higher tensile strength, but lower tear strength than obtained with the silicone, as would be expected as the urea makes the fabric somewhat stiffer. The results, however, are better than with the formaldehyde and catalyst alone. DP is not improved by the addition of urea.

In a preferred embodiment, formaldehyde, catalyst, silicone SM2112 and urea are used in the mix, the overall best results are obtained with both tensile and tear strength indicating a possible synergistic effect with the silicone and the urea. The DP is again boosted to 4.00 by the presence of the silicone.

Shrinkage was remarkably constant throughout all samples, showing extensions of approximately the same magnitude as compared to shrinkage of 6.42% on the untreated control.

EXAMPLE 29

Two rayon fabrics were tested by pressing in the hot head press at 350 degrees F. for 15 seconds. This pressing caused a severe shine in both fabrics, but it was more noticeable in the black butcher linen. Pressing after these fabrics had been treated with the process of the present invention produced no noticeable shine as summarized in the following table.

TABLE IX

Propensity for Glazing Rayon Fabrics by Pressing.

| Fabric/Color | Untreated Unpressed | Untreated Pressed | Treated Pressed |
|---|---|---|---|
| Rayon Twill/White | Slight Shine* | High Shine | Slight Shine |
| Rayon Linen/Black | No Shine | High Shine | No Shine |

Rayon fibers exhibit molecular movement when under heat and pressure, thus deforming the fibers, making flat spots. If enough flat spots are produced, the fiber begins to act like a mirror and instead of reflecting light in all directions it makes the light reflect in one direction, causing a bright "shine". If severe enough, as in the case of the black fabric, a total change of shade occurs.

The process of the present invention, with its molecular cross linking abilities renders the molecular structure rigid, so that when the fabric is pressed, the molecules cannot move, thus no flat spots are produced, and the fabric look the same as the original unpressed fabric.

This property is extremely valuable, as rayon pressing shine has been a problem since rayon appeared on the market in the late 1920's or 1930's. One might surmise that with the extensive cross linking furnished by the process of the present invention that the Non-Shine effect would be far better than can be obtained with resins, where much of the smoothness comes from the presence of resin in the largely amorphous rayon fiber. That is why rayon fabrics which are washed, and loose the resins, shine badly when pressed by hand iron.

The following examples illustrate the application of the process to fabrics made of silk or wool.

EXAMPLE 30

Three samples of a wool Challis fabric and one sample of a silk fabric measuring 18×36 inches were padded with a treatment solution and run through squeeze rollers to provide the amount of treatment chemicals as indicated in the Table X. The treated fabric was applied to a pin frame and cured in an oven at the temperatures indicated. The pinned fabric was removed from the oven and then from the pin frame. The physical properties of the treated fabric were measured and recorded and are shown in TABLE X.

It is clear from Table X that increasing the amount of formaldehyde on the weight of the fabric (OWF) improves the DP value but reduces the strength of the fabric. This is also true with respect to the amount of shrinkage and the results show an entirely unexpected combination of DP and reduction in shrinkage.

TABLE X

| Sample No. | Fabric | CH20 % OWF | Cat LF % OWF | SWES % OWF | Cure/Time Deg F./Min | Tensile, Lbs W × F | Tear Oz. W × F | Shrink 2-Washes W × F | DP 2-Washes | Shrink 5-Washes W × F | DP** 5-Wash |
|---|---|---|---|---|---|---|---|---|---|---|---|
| 591 | Wool | 4.0 | 2.5 | 1.5 | 300/10 | 37.3 × 16.3 | 79.5 × 47.9 | 0.67 × 1.83 | 3.25 | 1.58 × 2.83 | 3.25 |
| 593 | Wool | 16.0 | 4.0 | 1.5 | 300/10 | 38.3 × 14.7 | 74.0 × 28.7 | 1.08 × 1.25 | 3.50 | 1.75 × 2.17 | 3.50 |
| 595 | Wool | 20.0 | 4.5 | 1.5 | 300/10 | 38.8 × 14.0 | 73.3 × 29.4 | 73.3 × 29.4 | 3.40 | 1.58 × 2.33 | 3.35 |
| 599 | Wool Control | — | — | — | — | 40.1 × 18.5 | 67.7 × 30.0 | 67.7 × 30.0 | 2.00 | 5.58 × 13.17 | 1.50 |
| 597 | Silk | 16.0 | 4.0 | 1.5 | 300/10 | 98.7 × 65.2 | 53.1 × 77.4 | 4.92 × 2.17 | 3.50 | 5.50 × 2.25 | 3.25 |
| 508 | Silk Control | — | — | — | — | 93.3 × 69.2 | 45.6 × 36.8 | 11.17 × 6.08 | 2.75 | 14.42 × 6.75 | 2.00 |

The slight shine in the original fabric is due to the bright rayon fibers used. The pressing did, however increase the shine, but the treatment of the present invention did not show the increased shine, and looked like the original fabric.

It is clear that treatment in accordance with the present invention either retards shining by pressing, or eliminates it altogether. Shining is a serious problem with rayon fabrics not only by the consumer but in the processing mill where glazed spots appear wherever the fabric touches hot metal.

What is claimed:

1. A method of treating a textile comprising fibers selected from the group consisting of cellulosic fibers, protein fibers and mixtures thereof, comprising the steps of:

(a) contacting the textile with a liquid composition comprising formalin in an amount sufficient to provide from 0.56% to 7.4%, on weight of fabric, formaldehyde, and (b) heat curing the textile, wherein the formalin comprises formaldehyde and water, wherein the textile is provided with a silicone elastomer, and wherein the treated textile is unresinated.

2. A method according to claim 1, wherein the liquid composition comprises formalin in an amount sufficient to provide from 1.11% to 7.4%, on weight of fabric, formaldehyde.

3. A method of treating a textile comprising fibers selected from the group consisting of cellulosic fibers, protein fibers and mixtures thereof, comprising the steps of:

(a) moistening the textile with a moistening solution comprising water, (b) contacting the moistened textile with a liquid composition comprising formalin in an amount sufficient to provide from 0.56% to 7.4%, on weight of fabric, formaldehyde, and (c) heat curing the textile, wherein the formalin comprises formaldehyde and water, wherein the textile is provided with a silicone elastomer, and wherein the treated textile is unresinated.

4. A method according to claim 3, wherein the moistening solution further comprises a non-ionic wetting agent.

5. A method according to claim 1, wherein the textile comprises rayon fibers, and wherein the textile exhibits decreased shine due to pressing.

6. A method according to claim 5, wherein the liquid composition comprises formalin in an amount sufficient to provide from 2.96% to 7.4%, on weight of fabric, formaldehyde.

7. A method according to claim 1, wherein the textile is a fabric comprising wool fibers, and wherein the liquid composition comprises formalin in an amount sufficient to provide from 1.48% to 7.4%, on weight of fabric, formaldehyde.

8. A method according to claim 7, wherein prior to the step of contacting the fabric with the liquid composition the fabric is shrink proofed.

9. A method according to claim 8, the fabric is shrink proofed by a treatment selected from the group consisting of chlorination, treatment with potassium permanganate, and treatment with hydrogen peroxide.

10. A method according to claim 1, wherein the method further comprises the step of treating the fabric with a formaldehyde removing agent after the step of heat curing.

11. A method according to claim 10, wherein the formaldehyde removing agent is an organic acid.

12. A method according to claim 1, further comprising the step of contacting the textile with catalyst.

* * * * *